US006957691B2

(12) United States Patent
Hsieh

(10) Patent No.: US 6,957,691 B2
(45) Date of Patent: Oct. 25, 2005

(54) SEALING STRUCTURE OF A HEAT-DISSIPATING TUBE

(76) Inventor: Pao-Shu Hsieh, 19-6 Fl., No. 122, Chung Cheng Road, ChungHo City, Taipei Hsien (TW)

( * ) Notice: Subject to any disclaimer, the term of this patent is extended or adjusted under 35 U.S.C. 154(b) by 0 days.

(21) Appl. No.: 10/704,585

(22) Filed: Nov. 12, 2003

(65) Prior Publication Data

US 2005/0098302 A1 May 12, 2005

(51) Int. Cl.[7] ..... F28D 15/04

(52) U.S. Cl. ..... 165/104.26; 165/104.21

(58) Field of Search ..... 165/104.21, 104.26; 29/890.032

(56) References Cited

U.S. PATENT DOCUMENTS

| | | | | |
|---|---|---|---|---|
| 3,680,189 | A * | 8/1972 | Noren | 29/890.032 |
| 4,541,261 | A * | 9/1985 | Yanadori et al. | 165/104.26 |
| 4,565,002 | A * | 1/1986 | Matsuo et al. | 29/623.4 |
| 6,230,407 | B1 * | 5/2001 | Akutsu | 29/890.032 |
| 6,793,009 | B1 * | 9/2004 | Sarraf | 165/104.26 |
| 2002/0056542 | A1 * | 5/2002 | Yamamoto et al. | 165/104.26 |
| 2003/0159806 | A1 * | 8/2003 | Sehmbey et al. | 165/104.26 |

* cited by examiner

*Primary Examiner*—Teresa J. Walberg
(74) *Attorney, Agent, or Firm*—Rosenberg, Klein & Lee

(57) ABSTRACT

The invention relates to a sealing structure of a heat-dissipating tube having a neck formed at the top of the tube. The neck is compressed to a semicircular member in a closed state. Moreover, the top of the semicircular member is spot-welded to created a sealing layer. Thereby, the sealing structure of the tube can be fully closed and is not subject to break.

1 Claim, 4 Drawing Sheets

SEALING STRUCTURE OF A HEAT-DISSIPATING TUBE

BACKGROUND OF THE INVENTION

1. Field of the Invention

The invention relates to a sealing structure of a heat-dissipating tube, and more particularly, to a structure for sealing the distal end of the tube without break.

2. Description of the Related Art

TW 488632 discloses a heat-dissipating tube, as shown in FIG. 1, that the sealing end of the tube 10 is compressed to a U-shaped member 11 in the axial direction. The free end of the member 11 is spot-welded to create a sealed part 12. The member 11 is covered with a soft metal tin-welded layer 13. Moreover, the member 11 is rounded to form a conic sealing part 14 whose diameter smaller than that of the tube 10. Due to the rounding process, it's likely that the compression surface of the member 11 is slipped away or the sealed part 12 comes off. Thus, it is subject to break at the distal end of the conic sealing part.

SUMMARY OF THE INVENTION

It is a primary object of the invention to provide a sealing structure of a heat-dissipating tube whose sealing end is not subject to break.

In order o reach the above-mentioned object, the sealing structure of a heat-dissipating tube in accordance with the invention includes a neck formed at the top of the tube. The neck is compressed to a semicircular member in a sealed state. Moreover, the top of the semicircular member is spot-welded to created a sealing layer. Thereby, the tube is fully sealed and is not subject to break.

BRIEF DESCRIPTION OF THE DRAWINGS

The accomplishment of this and other objects of the invention will become apparent from the following descriptions and its accompanying drawings of which.

DETAILED DESCRIPTION OF THE PREFERRED EMBODIMENT

Figure 1:
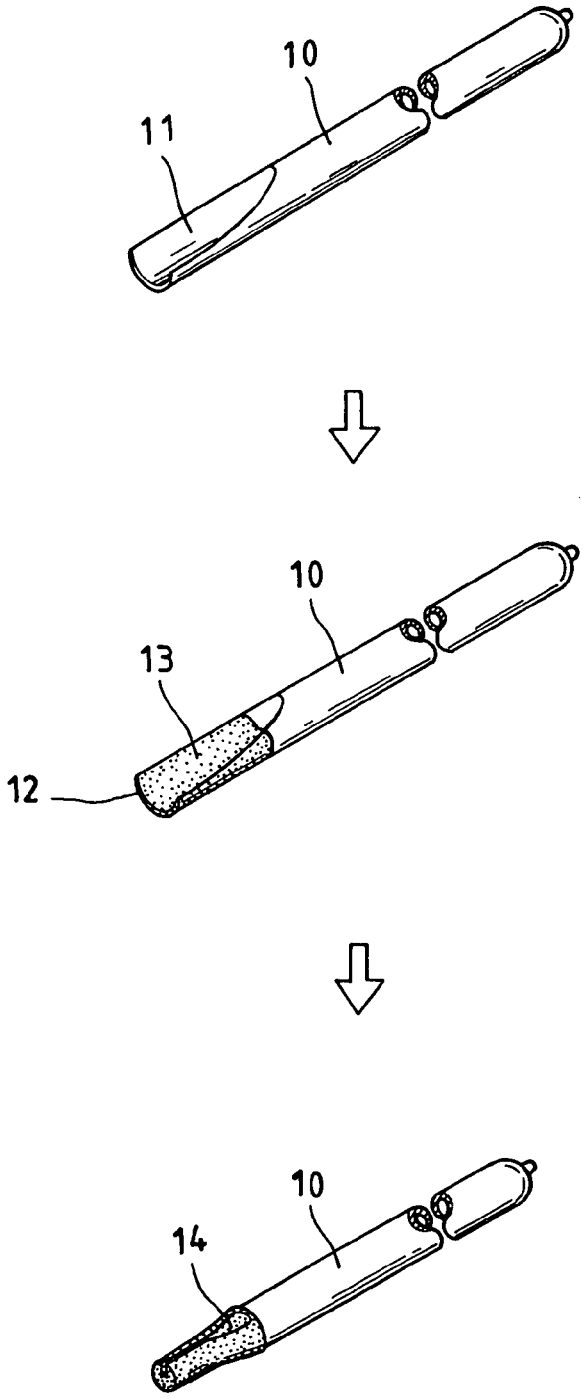
FIG.1 PRIOR ART
FIG. 1 is perspective drawings of a tube in accordance with the prior art from TW 488632, showing the processing procedures thereof.
Figure 2:
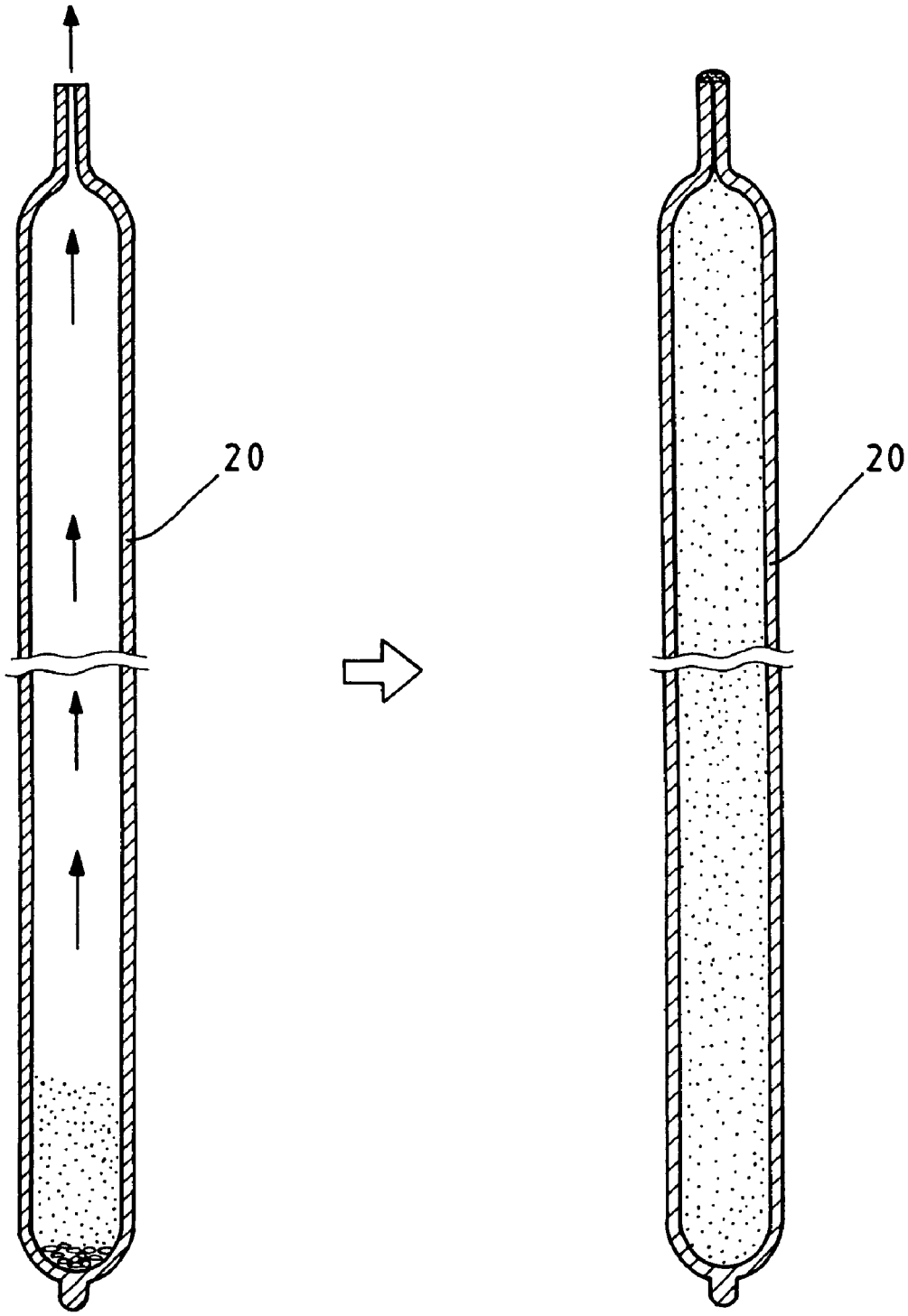
FIG. 2 PRIOR ART
FIG. 2 is a sectional view of the heat-dissipating tube, showing the processing procedures of creating a vacuum by use of the heating process for air expulsion.

First of all, referring to FIG. 2, a vacuum within the tube 20 is created by use of the heating process for air expulsion. This is achievable by feeding a small amount of pure water into the tube 20 first. After the tube 20 is heated, the water inside absorbs the heat and vaporizes. When the tube is full of steam, air originally located in the tube is expelled to the outside of the tube 20, and it's now time to seal the opening by pressing. Therefore, a vacuum in the tube 20 is created.

Figure 3:
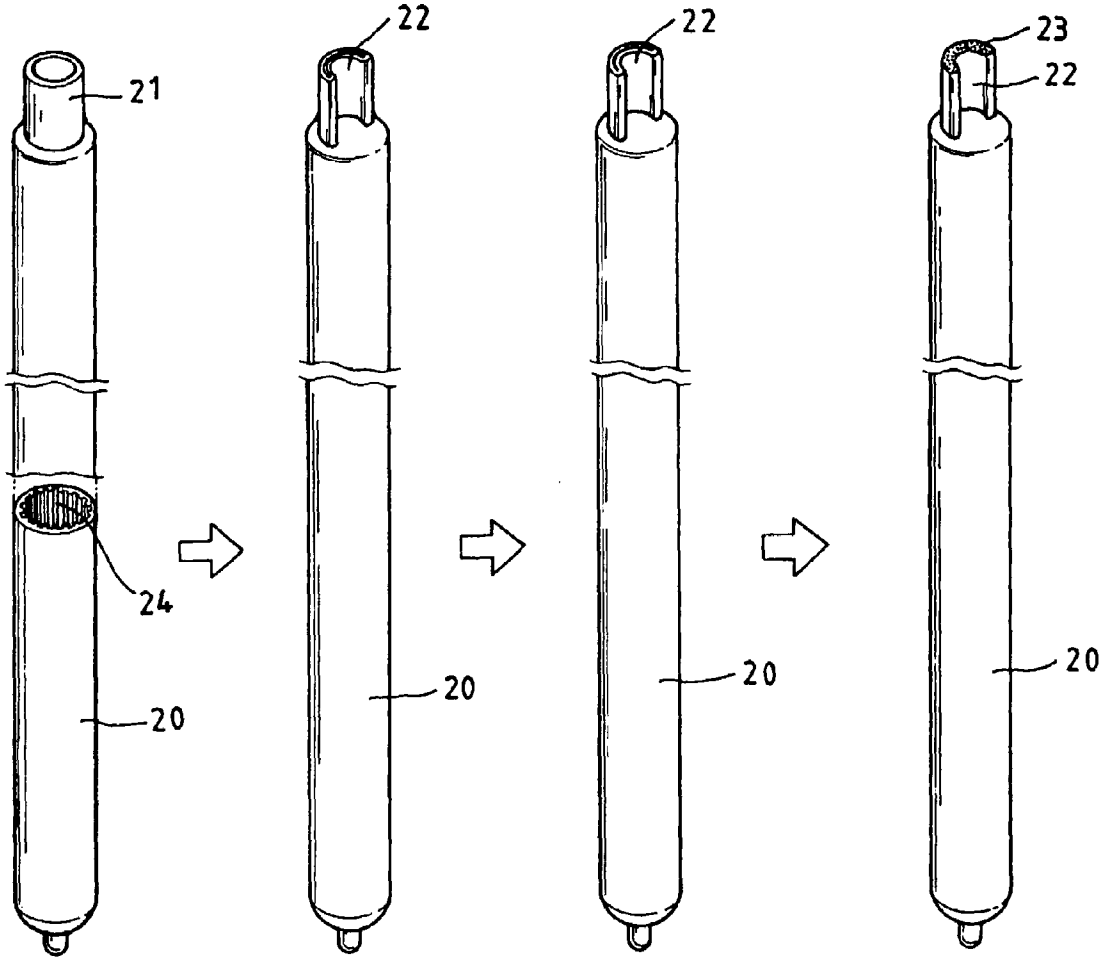
FIG. 3 is perspective drawings of a tube in accordance with the invention, showing the processing procedures thereof.
Figure 4:
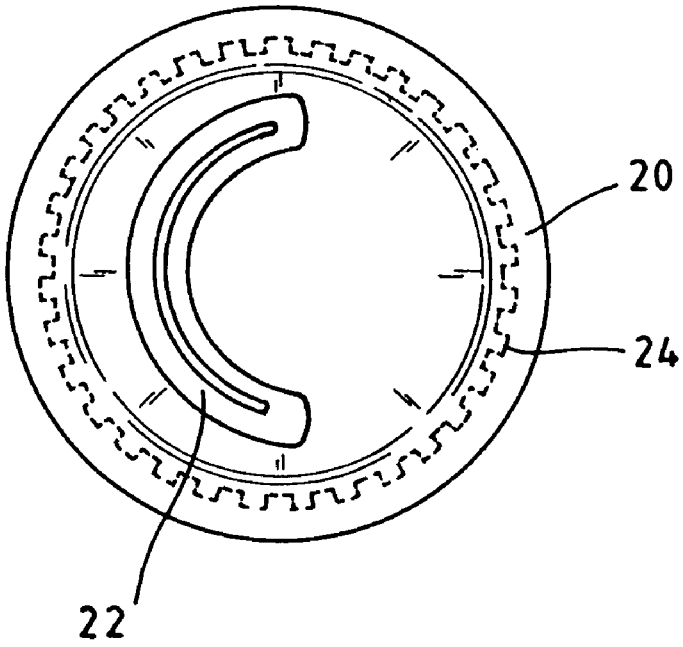
FIG. 4 is a cross-sectional view of the tube in accordance with the invention, showing that the sealing part is not completely closed.
Figure 5:
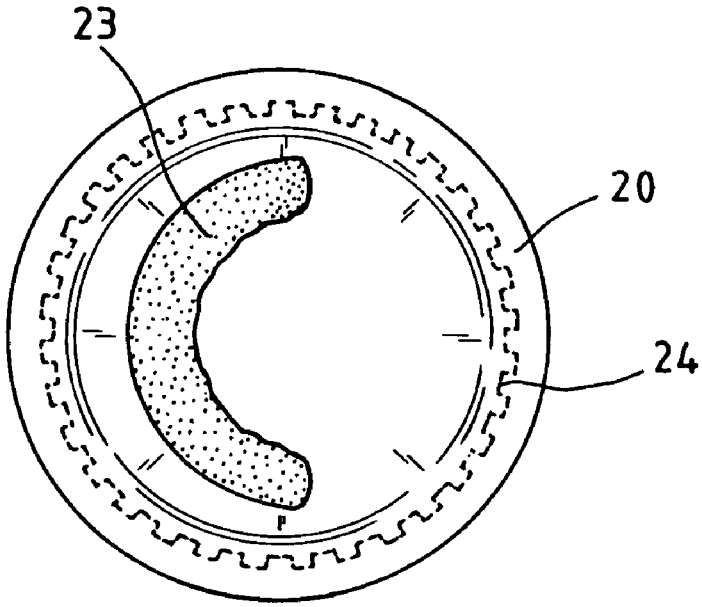
FIG. 5 is a cross-sectional view of the tube in accordance with the invention, showing that the sealing part is spot-welded with a sealing layer.

In order to reach a more efficient utilization of the above-mentioned principle, as shown in FIG. 3, a neck 21 of smaller diameter is disposed on the distal end of the tube 20. Then, water is fed into the tube 20. The half part of the neck 21 is compressed to another half part to create a semicircular member 22 in an open state (see FIG. 4). Thereafter, it is to undergo the air-expulsion process by heating. After the vacuum in the tube 20 is created, it's time to seal the semicircular member 22 by pressing. Moreover, the semicircular member 22 in the open state can be spot-welded to create a sealing layer 23 (see FIG. 5). In addition, a plurality of axial slots 24 are disposed at the internal rim of the tube 20.

Moreover, by use of a conventional pump to create a vacuum, the neck 21 will be directly compressed to a completely closed semicircular member 22.

Based upon the above-mentioned configuration, the neck 21 is formed at the top of the tube 20, and the diameter of the neck 21 is smaller than the original diameter of the tube 20. Thereafter, the neck 21 is compressed to a closed semicircular member 22. After the sealing layer 23 is spot-welded, the processing procedure is completed. Unlike the conventional prior art that requires a rounding process for reducing the diameter at the top of the tube, the invention is not subject to break caused by the rounding process, and the distal end of the tube in accordance with the invention can be fully sealed in a closed state.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A sealing structure of a heat-dissipating tube comprising a longitudinally extended tubular body having a closed first end and a neck formed at an opposing second end of said tubular body, said neck having a length extending longitudinally from said tubular body and a diameter smaller than a diameter of said tubular body, said neck being compressed to have a semicircular contour, said diameter of semicircularly contoured neck being substantially constant throughout said length of said neck, said semicircularly contoured neck having a distal end being spot-welded to form a sealing layer thereon to form a finished heat dissipating tube.

* * * * *